US006113413A

United States Patent [19]

Cronin et al.

[11] Patent Number: 6,113,413

[45] **Date of Patent: *Sep. 5, 2000**

[54] LATCHABLE ELECTRICAL CONNECTOR

[75] Inventors: Brian P. Cronin, Naperville, Ill.; William Gordon Fogarty, Belfast; Shea Morrissey, Kildare, both of Ireland

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/664,053

[22] Filed: Jun. 13, 1996

[51] Int. Cl.[7] ..... H01R 13/627

[52] U.S. Cl. ..... 439/352; 439/358

[58] Field of Search ..... 439/350–355, 439/357, 358, 372

[56] References Cited

U.S. PATENT DOCUMENTS

| | | | |
|---|---|---|---|
| 3,723,944 | 3/1973 | Gauchat et al. | 439/352 |
| 4,002,389 | 1/1977 | Mammel | 439/352 |
| 5,213,533 | 5/1993 | Walden | 439/352 |
| 5,580,182 | 12/1996 | Lin | 439/352 |
| 5,702,266 | 12/1997 | Jones | 439/352 |
| 5,863,214 | 1/1999 | Hanak | 439/352 |

*Primary Examiner*—Hien Vu
*Attorney, Agent, or Firm*—Stephen Z. Weiss

[57] ABSTRACT

An electrical connector includes a dielectric housing having a forward connecting section for connection with a complementary electrical connector in a mating direction. A pair of latch members extend in the mating direction along respective sides of the connecting section and each member includes a fixed end mounted in the housing and a free end engageable with an appropriate latch on the complementary electrical connector. The latch members are pivotally movable about the fixed ends from latch positions in latching engagement with the latch on the complementary electrical connector to release positions disconnected from the complementary connector. An actuator is pivotally mounted on the housing for pivotal movement from an inoperative position to an actuating position about an axis extending generally transverse to the mating direction. The actuator includes a cam engageable with the latch members for simultaneously moving the latch members from their latch positions to their release positions.

13 Claims, 4 Drawing Sheets

LATCHABLE ELECTRICAL CONNECTOR

FIELD OF THE INVENTION

This invention generally relates to the art of electrical connectors and, particularly, to a system for latching an electrical connector with a complementary electrical connector or other connecting device.

BACKGROUND OF THE INVENTION

In mating electrical connector systems, it often is desirable or important to look or latch two mating connectors to one another for ensuring proper and complete interconnection of the connector terminals and to further ensure ongoing connection of the connectors. This is particularly prevalent in environments where the connector assembly is subject to vibration or movement or low insertion and/or withdrawal forces where the connectors may become unintentionally or inadvertently disconnected.

Some connector latching systems use actuators to operate latch members by means of push buttons or the like. One of the problems with push button actuators is that they are unduly complicated and require significant additional components, such as return springs and the like. This adds considerably to the cost of manufacturing the connector and also increase the number of components that can become damaged or broken during use.

Another type of actuating system for electrical connector latch mechanisms involves the use of a sliding actuator button. While the sliding button does not always require a return spring as with the aforementioned push button actuator, sliding buttons are difficult to operate, tend to enlarge the overall size or envelope of the connector and are quite prone to become jammed during use, particularly if dirt or other debris accumulate about the slide button.

The present invention is directed to solving these various problems by providing a new push button type latch actuator for an electrical connector which is reliable and simple to use and requires a minimum number of additional components. In fact, other than the latches themselves, the present invention utilizes only one additional component, namely the actuator push button which has integrated or integral mounting means and actuating means.

SUMMARY OF THE INVENTION

An object, therefore, of the invention is to provide a new and improved latching means or system for an electrical connector of the character described.

In the exemplary embodiment of the invention, an electrical connector includes a dielectric housing having a forward connecting section for connection with a complementary electrical connector in a mating direction. A pair of latch members extend in the mating direction along respective sides of the connecting section. Each latch member includes a fixed end mounted in the housing and a free end engageable with means, on the complementary electrical connector, for latching to the latch members. The latch members are pivotally movable about their fixed ends from latch positions in latching engagement with the means for latching on the complementary electrical connector to release positions disconnected from the complementary connector. An actuator is pivotally mounted on the housing for pivotal movement from an inoperative position to an actuating position about an axis extending generally transverse to the mating direction. The actuator includes means for engaging the latch members for simultaneously moving the latch members from their latch positions to their release positions.

As disclosed herein, the actuator is part of a unitary molded structure which includes a push button movably mounted in an opening in the housing, a pivot rod integrally molded with the push button and located interiorly of the housing and cam means molded integrally with the push button and located interiorly of the housing for engaging the latch members. The latch members include engaging sections between their fixed ends and their free ends for engagement by the cam means on the actuator.

The latch members comprise spring members adapted to be biased for automatically returning from their release positions back to their latch positions. The means for engaging the latch members include means for camming the latch members which are arranged and structured on the actuator to bias the actuator from its actuating position to its inoperative position in response to movement of the spring latch members from their release positions back to their latch positions. The means for camming include cam surfaces engaging the spring latch members at an angle to the direction of movement of the members.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
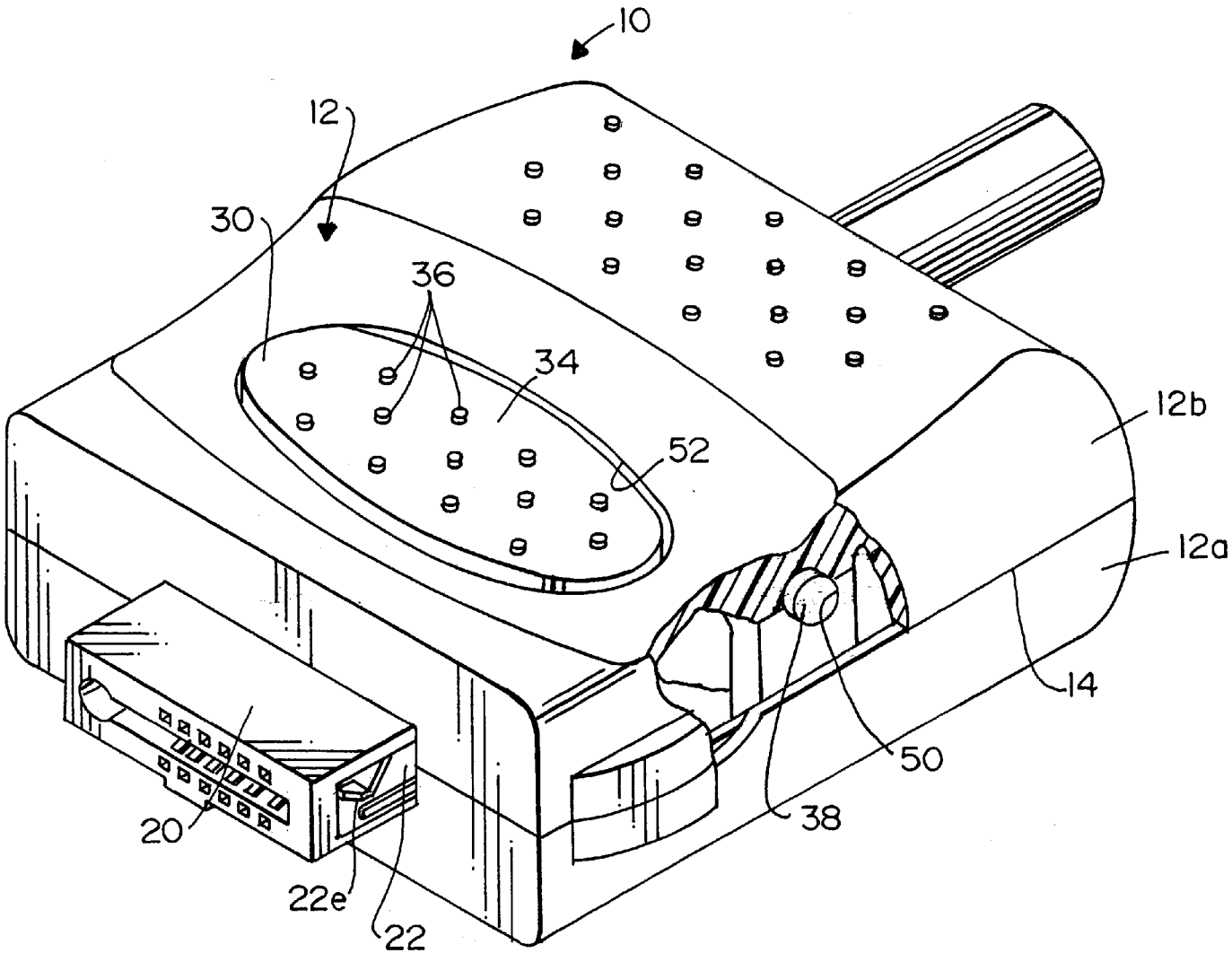
FIG. 1 is a perspective partial broken away view of an electrical connector embodying the concepts of the invention.
Figure 2:
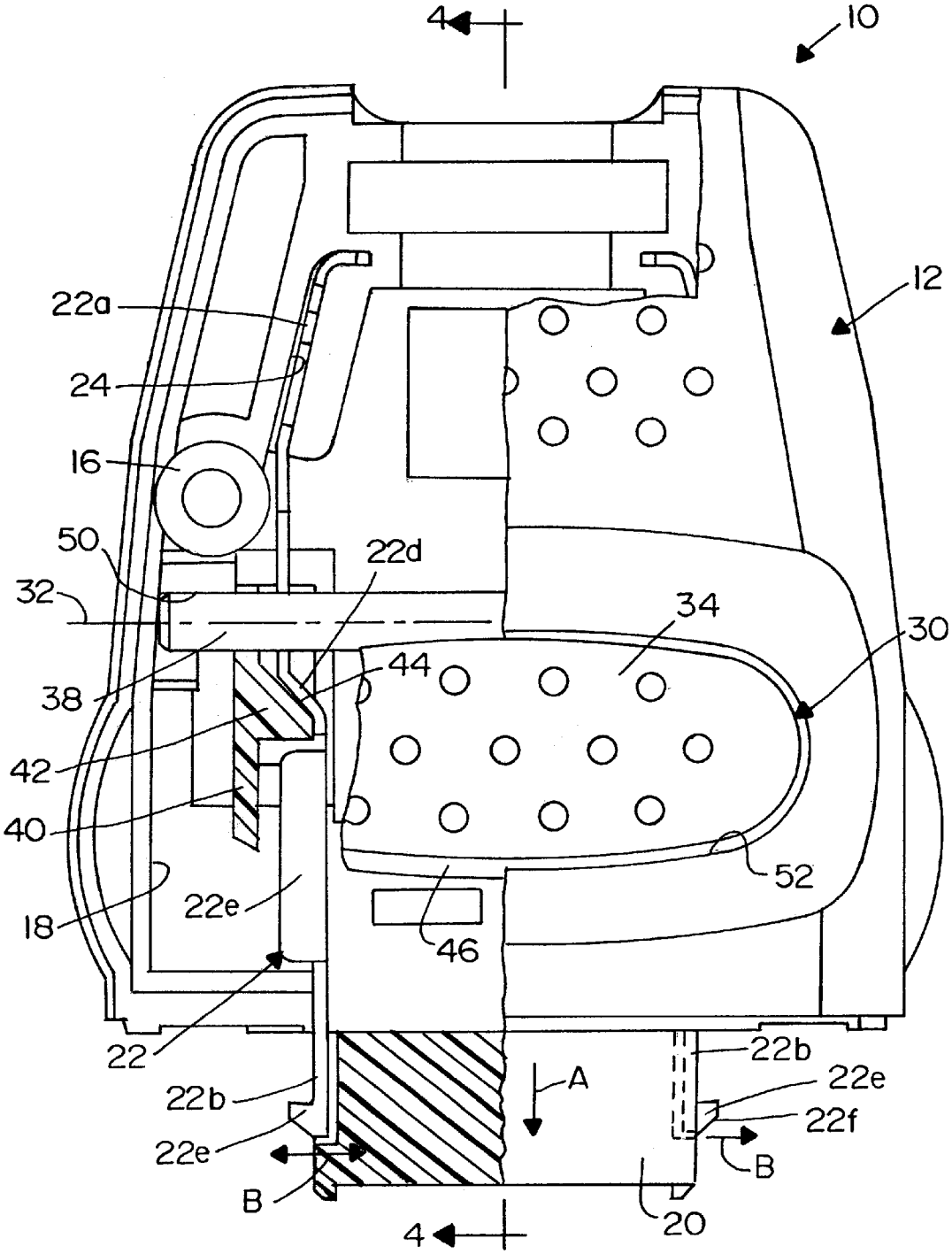
FIG. 2 is a top plan view of the connector, partially broken away to show the interior mounting of one of the spring latch members and the engagement of the member by the cam means of the push button.
Figure 3:
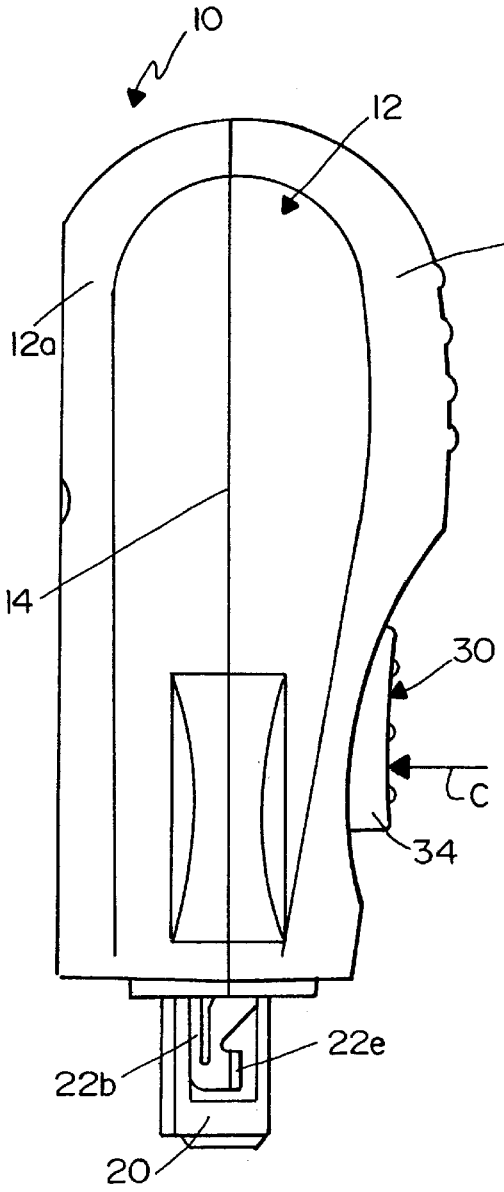
FIG. 3 is a side elevational view of the connector.
Figure 4:
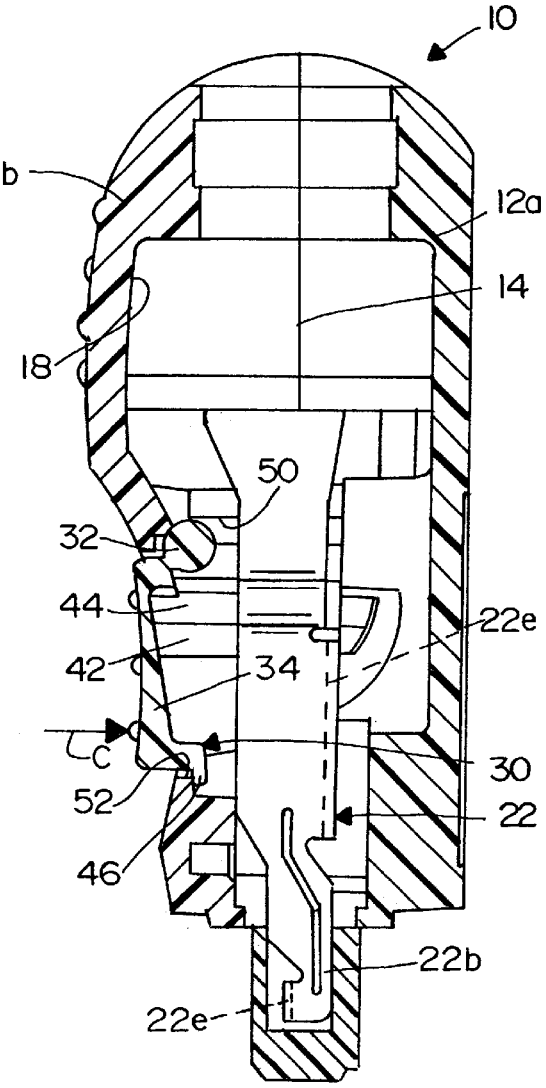
FIG. 4 is a vertical section taken generally along line 4—4 of FIG. 2.
Figure 8:
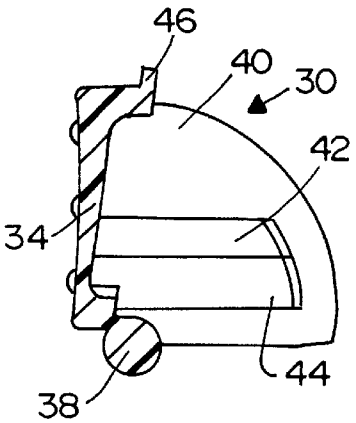
FIG. 8 is a section taken generally alone line 8—8 of FIG. 5.
Figure 7:
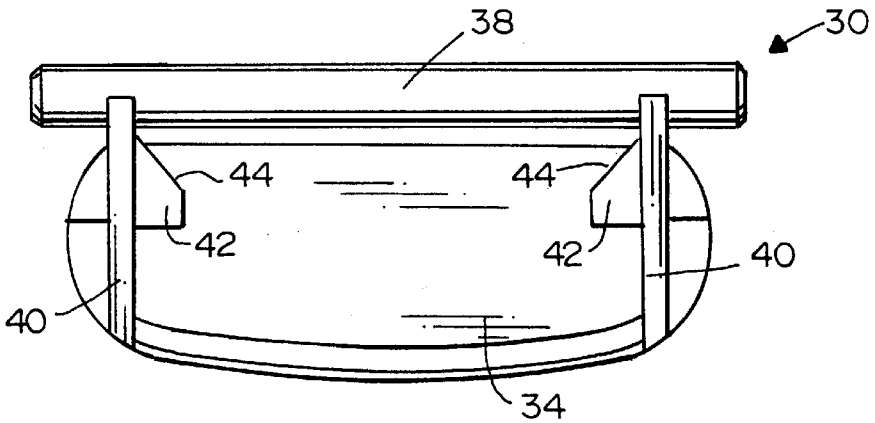
FIG. 7 is a bottom plan view of the actuator.
Figure 5:
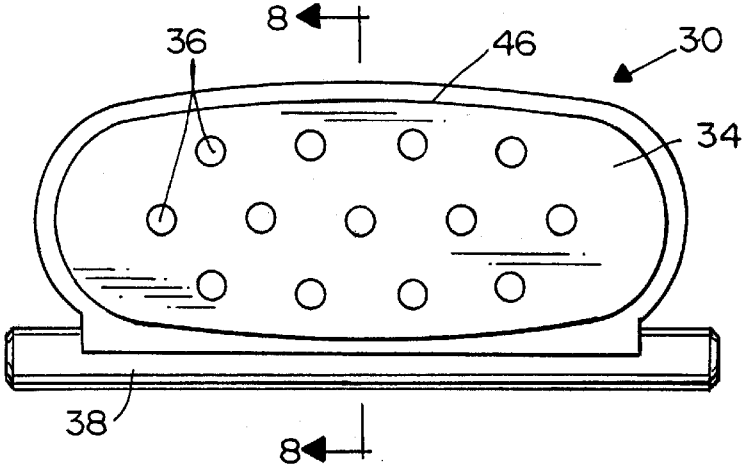
FIG. 5 is a top plan view of the actuator.
Figure 6:
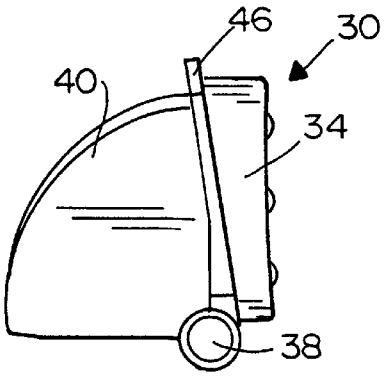
FIG. 6 is a side elevational view of the actuator.

Referring to the drawings in greater detail, and first to FIGS. 1–4, the latching means or system of the invention is incorporated in an electrical connector, generally designated 10, which includes a two-part dielectric housing, generally designated 12. The two parts of the housing are separable along a parting line 14 (FIGS. 3 and 4). The two parts of the housing are held together by appropriate fastening means, such as screws or bolts. FIG. 2 shows one of a plurality of bosses 16 for receiving the fastening means extending between the two housing parts. As seen best in FIGS. 3 and 4, the two housing parts include a lower part or shell 12*a* and an upper part or shell 12*b* defining an interior cavity 18. The connector includes a forwardly projecting connecting section 20 adapted for connection with a complementary electrical connector (not shown) in a mating direction as indicated by arrow "A" (FIG. 2).

A pair of spring latch members, generally designated 22, are mounted on housing 12 substantially within the interior cavity 18 of the housing and extending in the mating direction along respective opposite sides of connecting section 20. Each spring latch member 22 includes a fixed end 22*a* (seen best in FIG. 2), a free end 22*b*, a stabilizing or rigidifying section 22*c* and an angled engaging section 22*d*. Fixed end 22*a* of each spring latch member is press fit within an interior groove or slot 24 (FIG. 2). Free end 22*b* of each spring latch member is movable in the direction of doubleheaded arrows "B" (FIG. 2) generally transversely of or perpendicular to mating direction "A". The free end includes a hook 22*e* for latchingly engaging an appropriate latch surface of the complementary connector. Each hook 22*e* has a forwardly facing chamfered or angled surface 22*f*. Each spring latch member 22 is generally planar as best seen in FIG. 4, and stabilizing section 22*c* comprises a flange extending generally perpendicular to the plane of the latch member to rigidify the latch member in the area of the stabilizing flange. Lastly, engaging section 22*d* is angled, as best seen in FIG. 2, so as to be oblique to the mating direction indicated by arrow "A" as well as oblique to the movement of the latch members as indicated by double-headed arrow "B".

When connector 10 is mated with the complementary electrical connector (not shown) in the direction of arrow "A", the chamfered or angled surfaces 22*f* of spring latch members 22 will engage appropriate surfaces on the complementary electrical connector, and the spring latch members will be biased inwardly toward each other generally transverse to the mating direction from latch positions (shown in the drawings) to inward release positions. When the connectors are fully or properly mated, the spring latch members, being fabricated of metal material, will spring back to their latch positions as shown.

Generally, an actuator, generally designated 30, is pivotally mounted on housing 12 for pivotal movement from an inoperative position, as shown, to an actuating position about an axis 32 (FIGS. 2 and 4) extending generally transverse to mating direction "A". The actuator is effective to move the free ends of spring latch members 22 inwardly toward each other simultaneously with movement of the actuator.

More particularly, referring to FIGS. 5–8 in conjunction with FIGS. 1–4, actuator 20 is a one-piece, unitarily molded structure of dielectric material such as plastic or the like, although other appropriate material is contemplated. The actuator includes a push button 34 having integrally molded "bumps" 36 on the outside surface thereof for engagement by an operator, such as an operator's thumb. A pivot rod 38 is molded integrally with push button 34. A pair of side walls 40 are molded integrally with the underside of push button 34. A cam 42 is molded integrally on the inside of each side wall 40. Each cam includes an angled cam surface 44. Lastly, a peripheral lip 46 is molded integrally about push button 34. All of these details of the one-piece, unitarily molded actuator 30 are shown clearly in FIGS. 5–8.

Actuator 30 is mounted on housing 12 prior to assembling the two parts 12*a* and 12*b* of the housing. The opposite ends of pivot rod 38 are positioned within journals 50 (FIG. 2) interiorly of the housing so that the actuator is free to pivot or rotate about axis 32. When so mounted, push button 34 projects through an opening 52 in upper housing part 12*b* as seen best in FIGS. 2 and 4. Peripheral lip 46 engages the inside of the housing about opening 52 to define the outer extreme limit position of the push button. As seen in FIG. 2, one of the cams 42 on the inside of each side wall 40 on the underside of push button 34 is positioned such that the angled surface 44 of each cam faces or is juxtaposed against oblique engaging section 22*d* of a respective one of the spring latch members 22.

After connector 10 has been mated with the complementary electrical connector as described above, and when it is desired to disconnect the connectors, push button 34 of actuator 30 is depressed in the direction of arrows "C" (FIGS. 3 and 4). This causes the entire actuator, including push button 34 and cams 42 to pivot about pivot rod 38 and axis 32. Referring to FIG. 2, this pivoting movement of actuator 30 causes angled cam surfaces 44 to engage and move against juxtaposed angled engaging sections 22*d* of the respective spring latch member and drive the free ends 22*b* of the latch members inwardly transversely of mating direction "A". In other words, pivotal movement of actuator 30 from its inoperative position to its actuating position about axis 32 simultaneously moves latch members 22 inwardly toward each other from their latch positions to their release positions, thereby allowing disconnecting or uncoupling of the mating connectors.

When the connectors are disconnected, spring latch members 22 will self bias back to their latch positions as shown in FIG. 2, during which movement angled engaging sections 22*d* of the spring latch members will engage juxtaposed angled cam surfaces 44 and simultaneously bias actuator 30 and push button 32 back outwardly to the inoperative position shown in the drawings.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing having a forward connecting section extending outwardly therefrom for connection with a complementary electrical connector in a mating direction;

a pair of latch members extending in said mating direction along respective sides of the connecting section and each member including a fixed end mounted in the housing for engaging and holding the latch members and a free end engageable with means on the complementary electrical connector, the latch members being pivotally movable about said fixed ends from a latch position in latching engagement with the means for engaging and holding on the complementary electrical connector to a release position disconnected from the engaging and holding means on the complementary connector; and an actuator with an integrally molded push-button pivotally mounted in an opening in a side of the housing for pivotal movement from an inoperative position to an actuating position about an axis extending generally transverse to said mating direction when an external force is placed on the actuator and including a cam portion of said actuator integrally molded with the actuator for engaging the latch members for simultaneously moving the latch members from said latch position to said release position.

2. The electrical connector of claim 1 wherein said push button is integrally molded with a pivot rod located interiorly of the housing.

3. The electrical connector of claim 1 wherein each of said latch members include an engaging section between said fixed end and said free end for engagement by means for engaging on the actuator.

4. The electrical connector of claim 1 wherein said latch members comprise spring members integrally formed with the latch member, adapted to bias the latch members automatically returning the latch members from said release position back to said latch position when the external force is removed from the actuator.

5. The electrical connector of claim 4 wherein said portion of the actuator for engaging the latch members includes cam surfaces for moving the latch members, the cam surfaces being arranged and structured so that the actuator is biased from said actuating position to said inoperative position in response to movement of the latch members from said release position back to said latch position.

6. The electrical connector of claim 5 wherein said cam surfaces engaging the latch members at an angle to the direction of movement of the members.

7. An electrical connector, comprising:

a dielectric housing having a forward connecting section extending outwardly therefrom for connection with a complementary electrical connector in a mating direction;

a pair of latch members extending in said mating direction along respective sides of the connecting section and each member including a fixed end mounted in the housing for engaging and holding the latch members, a free end engageable with means on the complementary electrical connector and an engaging section between the fixed end and the free end, the latch members being pivotally movable about said fixed ends from a latch position in latching engagement with the means on the complementary electrical connector for engaging and holding the latch members to a release position disconnected from the engaging and holding means on the complementary connector, said latch members comprising spring members adapted to be biased for automatically returning from said release position back to said latch position; and a one-piece, unitarily molded actuator including a push button movably mounted in an opening in a side of the housing, a pivot rod molded integrally with the push button and being placed in the housing for mounting the actuator in the housing for pivotal movement from an inoperative position to an actuating position about an axis defined by the pivot rod extending generally transverse to said mating direction, and a cam portion molded integrally with the push button and located interiorly of the housing for engaging the engaging sections of the latch members to simultaneously move the latch members from said latch position to said release position.

8. The electrical connector of claim 7 wherein said cam surfaces are arranged and structured so that the actuator is biased from said actuating position to said inoperative position in response to movement of the latch members from said release position back to said latch position.

9. An electrical connector, comprising:

a dielectric housing having a forward connecting section extending outwardly therefrom for connection with a complementary electrical connector in a mating direction;

a spring latch member extending in said mating direction and including a fixed end mounted in the housing for engaging and holding the latch members and a free end engageable with means on the complementary electrical connector, the free end being movable transverse to said mating direction from a latch position to a release position and being spring biased toward the latch position; and an actuator with an integrally molded push button moveably mounted in an opening in a side of the housing for movement transverse to said mating direction and transverse to the direction of movement of the spring latch member and including a portion of said actuator integrally molded with the actuator for engaging the spring latch member for moving the spring latch member from said latch position to said release position in response to movement of the actuator when an external force is placed on the actuator from an inoperative position to an actuating position, the cam portion of said actuator for engaging being arranged and structured so that the actuator is biased to said inoperative position automatically in response to the latch member being spring biased to said latch position when the external force is removed from the actuator.

10. The electrical connector of claim 9 where said push button is integrally molded with a pivot rod located interiorly of the housing for pivotally mounting the actuator on the housing for movement between said inoperative and actuating positions.

11. An electrical connector, comprising:

a dielectric housing having a forward connecting section extending outwardly therefrom for connection with a complementary electrical connector in a mating direction;

a spring latch member extending in said mating direction and including a fixed end mounted in the housing for engaging and holding the latch members and a free end engageable with means on the complementary electrical connector, the free end being movable transverse to said mating direction from a latch position to a release position and being spring biased toward the latch position; and an actuator with an integrally molded push button mounted in an opening in a side of the housing for movement transverse to said mating direction and transverse to the direction of movement of the spring latch member and including a cam portion of said actuator integrally molded with the actuator for engaging the spring latch member for moving the spring latch member from said latch position to said release position in response to movement of the actuator when an external force is placed on the actuator from an inoperative position to an actuating position, the portion of said actuator for engaging being arranged and structured so that the actuator is biased to said inoperative position automatically in response to the latch member being spring biased to said latch position when the external force is removed from the actuator.

12. The electrical connector of claim 11 where said push button is integrally molded with a pivot rod located interiorly of the housing for pivotally mounting the actuator on the housing for movement between said inoperative and actuating positions.

13. An electrical connector, comprising:

a dielectric housing having a forward connecting section extending outwardly therefrom for connection with a complementary electrical connector in a mating direction;

a pair of latch members extending in said mating direction along respective sides of the connecting section and each member including a fixed end mounted in the housing for engaging and holding the latch members, a free end engageable with means on the complementary electrical connector and an engaging section between the fixed end and the free end, the latch members being pivotally movable about said fixed ends from a latch position in latching engagement with the means on the complementary electrical connector for engaging and holding the latch members to a release position disconnected from the engaging and holding means on the complementary connector, said latch members comprising spring members adapted to be biased for automatically returning from said release position back to said latch position; and a one-piece, unitarily molded actuator including a push button movably mounted in an opening in a side of the housing, a pivot rod molded integrally with the push button interiorly of the housing for mounting the actuating on the housing for pivotal movement from an inoperative position to an actuating position about an axis defined by the pivot rod extending generally transverse to said mating direction, and a cam portion molded integrally with the push button and located interiorly of the housing for engaging the engaging sections of the latch members to simultaneously move the latch members from said latch position to said release position, said cam surfaces being arranged and structured so that the actuator is biased from said actuating position to said inoperative position in response to movement of the latch members from said release position back to said latch position, said cam surfaces being further arranged and structured so that they engage the latch members at an angle to the direction of movement of the latch members.

* * * * *